US007216837B2

(12) United States Patent
Pineda

(10) Patent No.: US 7,216,837 B2
(45) Date of Patent: May 15, 2007

(54) DEVICE FOR HOLDING A CONTAINER

(76) Inventor: Andres Pineda, 60 Madrona Ave, Belvedere, CA (US) 94920

( * ) Notice: Subject to any disclaimer, the term of this patent is extended or adjusted under 35 U.S.C. 154(b) by 0 days.

(21) Appl. No.: 11/429,606

(22) Filed: May 5, 2006

(65) Prior Publication Data

US 2006/0278769 A1 Dec. 14, 2006

Related U.S. Application Data

(60) Provisional application No. 60/680,457, filed on May 11, 2005.

(51) Int. Cl.
*A47D 15/00* (2006.01)

(52) U.S. Cl. ..... 248/104; 248/152; 248/174; 248/311.3; 248/346.04

(58) Field of Classification Search ..... 248/104, 248/152, 174, 345.1, 311.3, 315, 318, 346.03, 248/346.04, 346.5; 211/73; 215/373–377, 215/395, 399; 206/562, 563, 217, 150; 220/737, 220/739, 903

See application file for complete search history.

(56) References Cited

U.S. PATENT DOCUMENTS 2,264,489 A * 12/1941 Tiegler et al. ..... 248/694
2,301,216 A * 11/1942 Koontz ..... 248/346.03
4,669,693 A * 6/1987 Kagan ..... 248/318
4,993,611 A * 2/1991 Longo ..... 224/148.4
6,986,487 B2 * 1/2006 Rich ..... 248/104

* cited by examiner

*Primary Examiner*—Korie Chan

(57) ABSTRACT

An inexpensive, lightweight, thin, portable, compact, reusable, easy to clean, holder that can support a container in an upright, inclined, or inverted position on level, non-level, and solid and liquid surfaces or suspended using a means of suspension, such as a wire. The generally star-shaped main body with radially extended arms, and containing a hole therein used to grip a container. The main body is incurvated into a concave shape by the insertion of a container into the hole located near the center of the main body. The incurvation occurs due to the elasticity of the material used for the main body forming a semi-rigid concave shape capable of supporting the weight of the container. The adaptability of the holder enables a wide range of uses for the invention.

7 Claims, 8 Drawing Sheets

DEVICE FOR HOLDING A CONTAINER

CROSS-REFERENCE TO RELATED APPLICATIONS

This application claims the benefits of Provisional Patent Ser. No. 60/680,457, Filed on 2005 May 11.

FEDERALLY SPONSORED RESEARCH

None.

SEQUENCE LISTING OR PROGRAM

None.

BACKGROUND OF THE INVENTION

1. Field of the Invention the present invention relates generally to container holders and particularly to adjustable holders 2. Background of the Invention The present invention is a holder for containers that is inexpensive, lightweight, thin, portable, compact, reusable, easy to clean, and adaptable to different sizes and shapes of containers. The holder can support containers in upright, inclined, or inverted positions on level, non-level, solid and liquid surfaces.

The present invention is particularly useful for the elderly, disabled, and young children where a container can easily be tipped over and cause a messy spill. The present invention is also ideal for consumers that use containers while outdoors or while playing in the water, such as a swimming pool or a lake, where there are limited flat surfaces upon which to place a container.

The following similar prior art references are cited and compared to the present invention:

U.S. Pat. No. 2,963,256 to Borah describes an article retainer that provides similar functionality to the present invention, but does not have the capability of laying flat when not in use, nor does it support containers in inclined positions, nor does it provide features for holding containers on non-flat surfaces because the invention relies on suction to hold the container to a flat surface. The invention also does not support containers on liquid surfaces.

U.S. Pat. No. 4,540,611 to Henderson describes a one piece container holder that does not lay flat when not in use. It is designed for a specific sized container and does not adapt to various container widths or shapes and it does not support containers on liquid surfaces.

U.S. Pat. Nos. 5,028,023 and 5,195,706 to Allen describe a one piece container holder that does not lay flat when not in use. It does not address supporting containers in inclined positions, nor does not support containers on liquid surfaces.

U.S. Pat. No. 5,088,673 to Chandler does not address supporting containers in inclined positions, nor does it support containers on liquid surfaces.

U.S. Pat. No. 5,154,380 to Risca describes a fixed structure that does not lay flat when not in use, nor does it have the capability for holding containers in inclined positions or on liquid surfaces.

U.S. Pat. No. 5,326,064 to Sapien describes a holder for preventing spills, but it is a fixed structure that does not lay flat when not in use and it does not support containers on liquid surfaces.

U.S. Pat. No. 6,637,082 to Chang describes similar functionality to the present invention, but it does not lay flat when not in use and does not support holding containers in inclined positions or on liquid surfaces.

U.S. Pat. No. 6,648,290 to Aleman does not lay flat when not in use and it does not support containers on liquid surfaces and it requires an additional external structure to which the holder is attached.

U.S. Pat. No. 6,749,167 to Kaupp does not support containers in inclined positions, nor does it lay flat when not in use and it does not support containers on liquid surfaces.

U.S. Pat. No. 6,764,053 to Han does not provide support for containers in inclined positions and it does not support containers on liquid surfaces.

U.S. Pat. No. 6,883,765 to Lozano provides only for fixed size containers and requires assembly before it can be used. It is designed to be disposable and therefore not durable or reusable and it does not support containers on liquid surfaces.

Many container holders that are available in the marketplace, and that are heretofore known, suffer from one or more of the following disadvantages:

- the holder is constructed of permanently rigid material, making the holder unable to lay flat when not in use,
- the holder is not capable of holding containers in all of the following positions: upright, inclined and inverted positions,
- the holder does not grip the container sufficiently to prevent the container from slipping out while in an inclined position,
- the holder is not buoyant and does not have the capability to support a container on a liquid surface,
- the holder is constructed of many smaller parts that are relatively expensive to manufacture, assemble, and package,
- the holder is not easily cleanable or requires special cleaning materials,
- the holder cannot accommodate different sized and shaped containers.

BACKGROUND OF INVENTION—OBJECTS AND ADVANTAGES

It is therefore a general object of the present invention to support containers in upright, inclined, or inverted positions on level, non-level, solid and liquid surfaces.

Another object of the invention is to be easy to install and remove, making it a reusable holder.

A further object of this invention is to support containers of different shapes and sizes.

Another object of the invention is to provide support for containers in an inexpensive manner.

It is a further object of this invention to support containers on a liquid surface, such as water.

Still a further object of this invention is to lay flat when not in use for convenient portability and storage.

Still a further object of this invention is to be simple to use and require no assembly or additional means of support.

Still another object of this invention is to provide a holder that can easily be cleaned with soap and water.

SUMMARY

The current invention comprises of a star-shaped main body that is die-cut or laser-cut from a sheet of flexible and elastic material, such as polymeric foam, a plurality of radially extending arms that are used to support the container, and a hole near the center of the main body that is used for gripping the container.

DRAWINGS

FIG. 1 is an isometric front-side view of the invention. Depicting the main body 100, the radially extended arms 120 and the hole 110 with tabs 130 around the edges.

Figure 5:
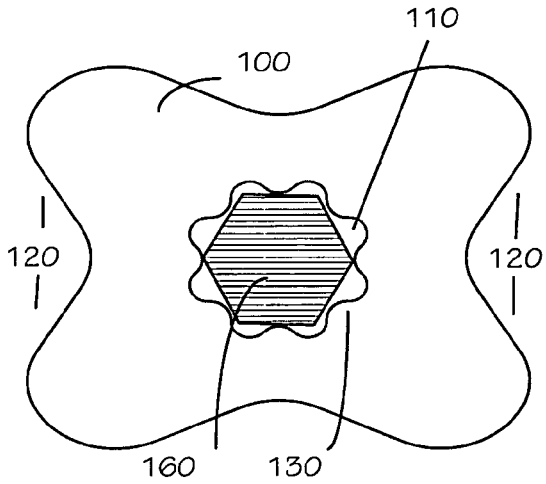

FIG. 5 is a top view of the invention depicting a hexagonally-shaped container 160 gripped by the tabs 130 around the edge of the hole 110.

Figure 6:
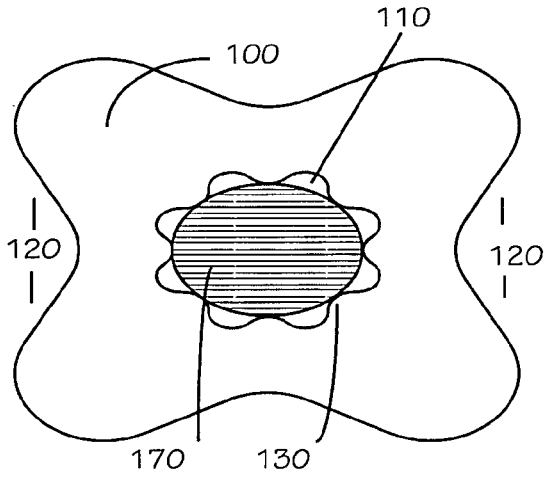

FIG. 6 is a top view of the invention depicting an oval-shaped container 170 gripped by the tabs 130 around the edge of the hole 110

Figure 7:
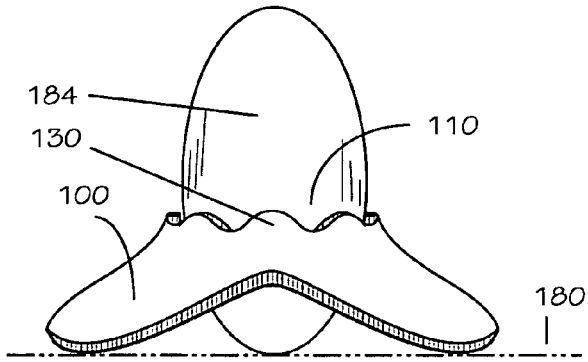

FIG. 7 is a side view of the invention depicting an ellipse-shaped container 184 gripped by the tabs 130 around the edge of the hole 110.

Figure 8:
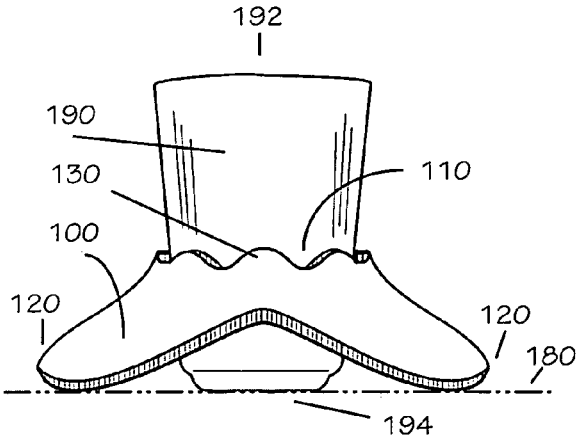

FIG. 8 is a side view of the invention with a water-glass shaped container 190 gripped by the tabs 130 around the edge of the hole 110.

Figure 9:
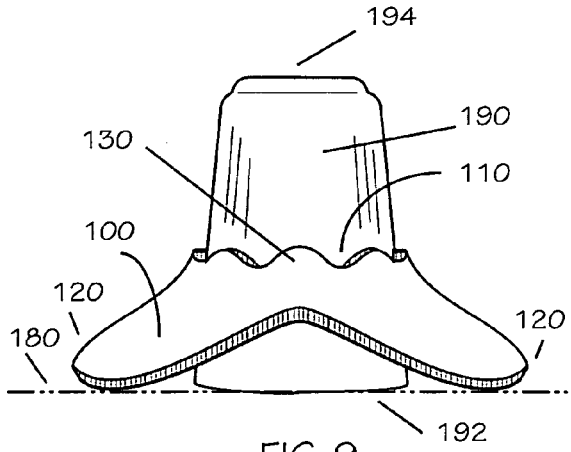

FIG. 9 is a side view of the invention with an inverted water-glass shaped container 190 gripped by the tabs 130 around the edge of the hole 110.

Figure 10:
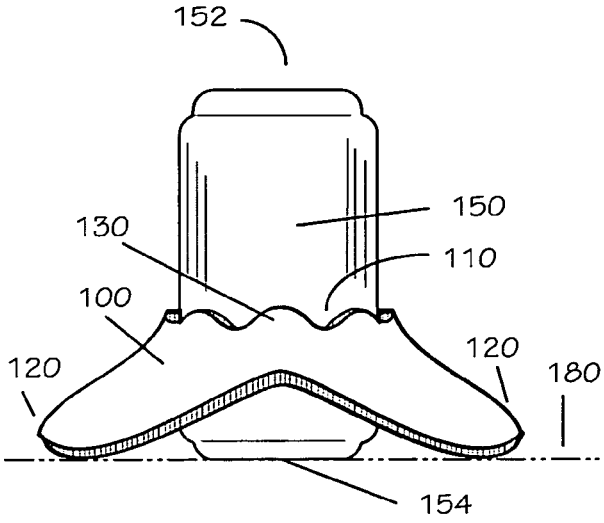

FIG. 10 is a side view of the main body 100 with the container 150 in an upright position gripped by the tabs 130 around the edge of the hole 110.

Figure 11:
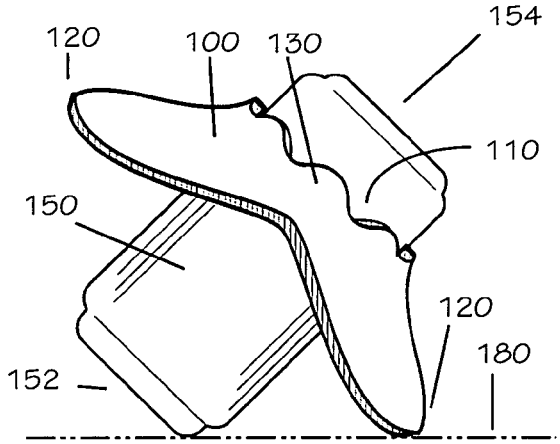

FIG. 11 is a side view of the main body 100 with the container 150 in an inclined position gripped by the tabs 130 around the edge of the hole 110.

Figure 12:
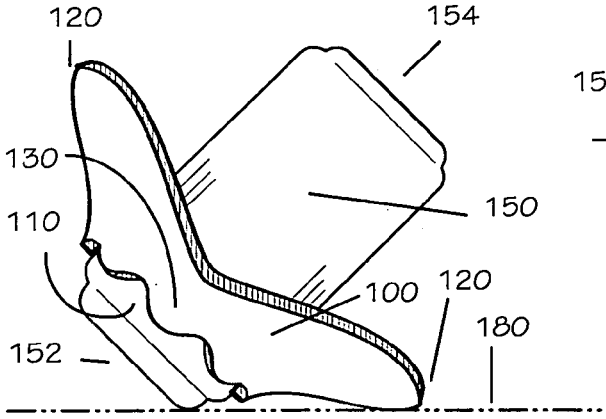

FIG. 12 is same view as FIG. 11, but with the main body 100 installed on the opposite end of the container 152.

Figure 13:
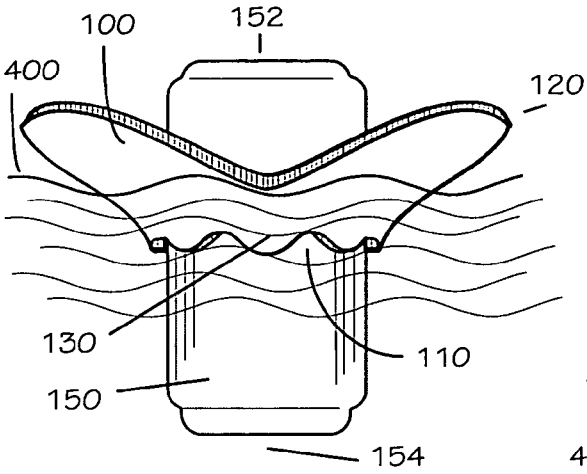

FIG. 13 is a side view of the main body 100 holding a container 150 in an upright position on a liquid surface 400.

Figure 14:
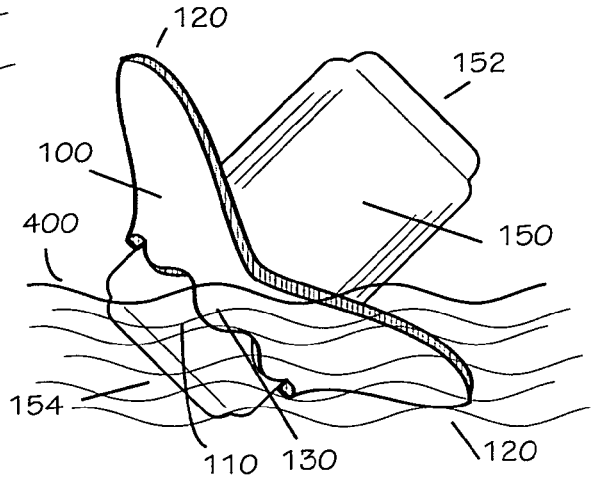

FIG. 14 is the same view of the main body 100 holding a container 150 in an inclined position on a liquid surface 400.

Figure 15:
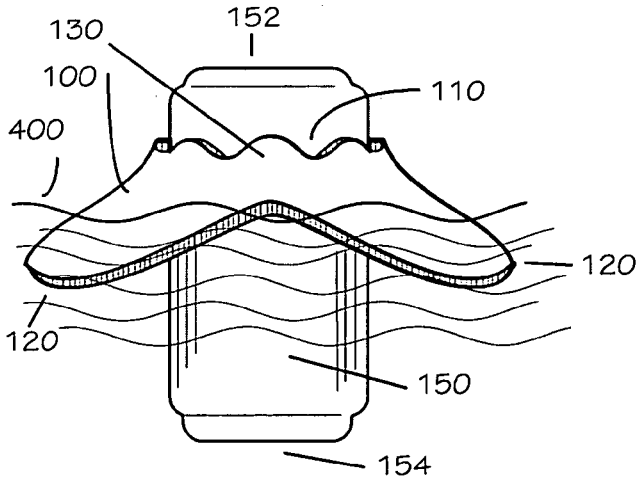

FIG. 15 is the same view as FIG. 13, but with the main body 100 installed in an inverted manner.

Figure 16:
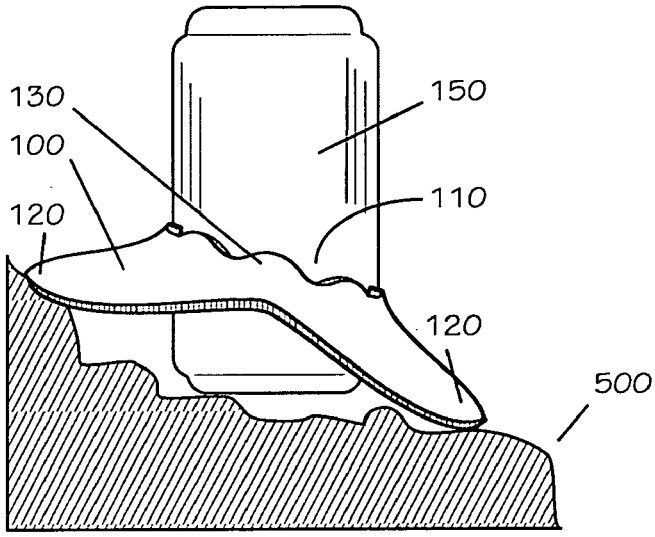

FIG. 16 is a side view of the main body 100 holding a container 150 on a non-level, non-flat solid surface 500.

Figure 17:
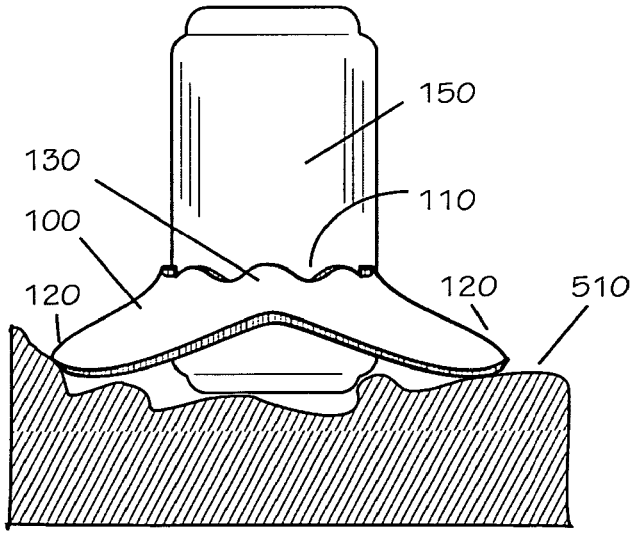

FIG. 17 is a side view of the main body 100 holding a container 150 on a level, non-flat solid surface 510.

Figure 18:
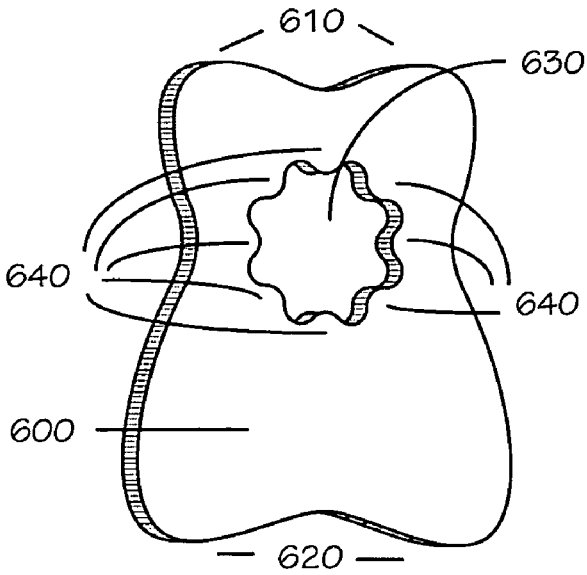

FIG. 18 is an isometric front-view of an alternative embodiment of the main body 600 in the form of a baby bottle holder.

Figure 19:
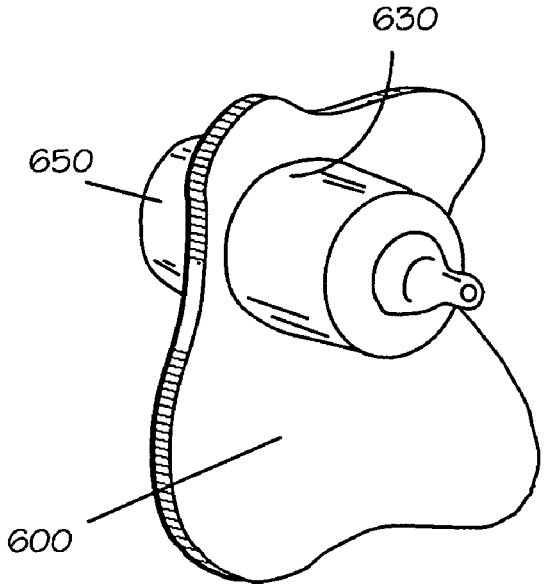

FIG. 19 is an isometric view of FIG. 18.

Figure 20:
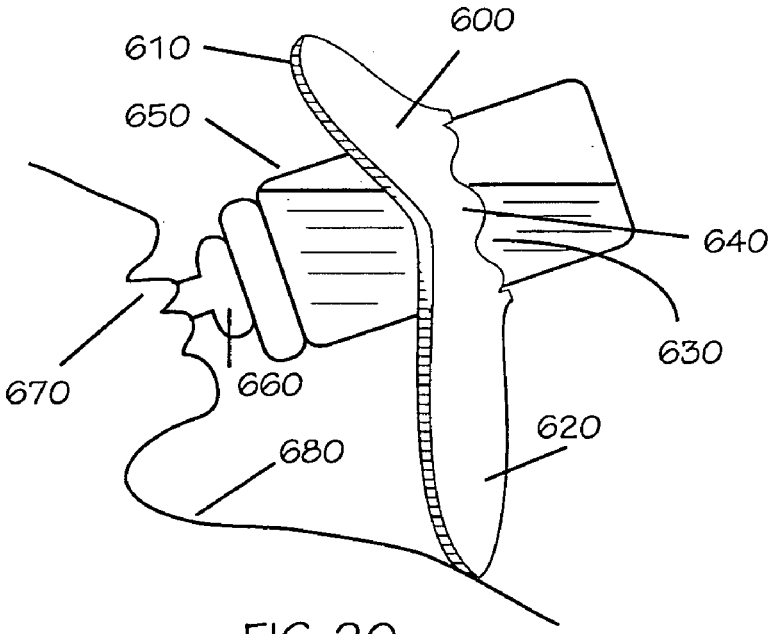

FIG. 20 is a side-view of FIG. 19 while in use as a baby-feeding support for a baby bottle 650.

Figure 21:
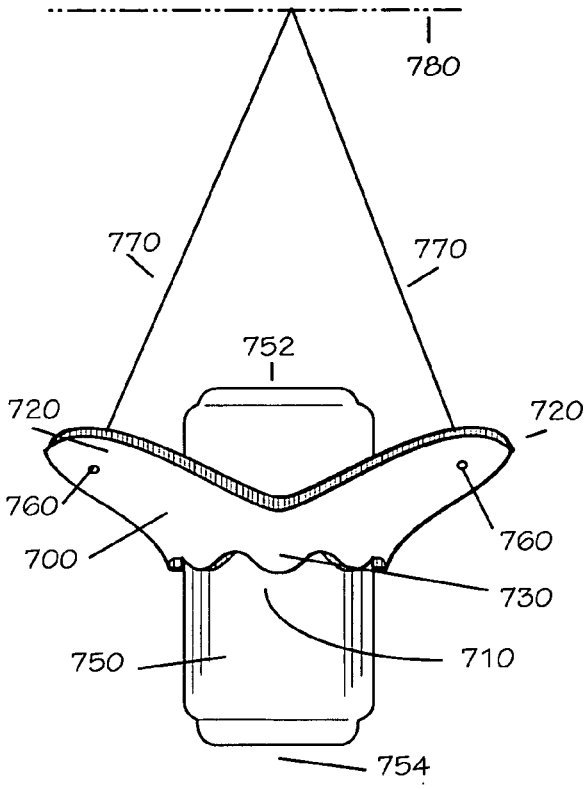

FIG. 21 is a side-view of the invention holding an upright container 750 while suspended by a means consisting of wire or string 710 from an upper support 780.

Figure 22:
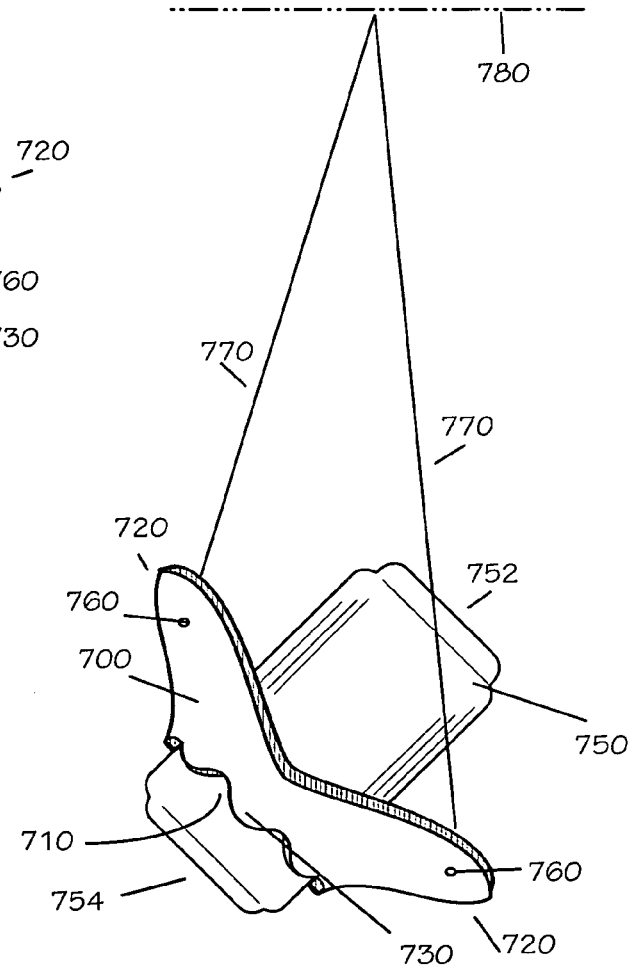

FIG. 22 is a side-view of the invention holding an inclined container 750 while suspended by a means consisting of wire or string 710 from an upper support 780.

DESCRIPTION OF THE PREFERED EMBODIMENT—HOLDER ON A SURFACE

Referring now to the drawings, in which similar or corresponding parts are identified with the same reference number, the present invention is generally depicted in FIG. 1 through FIG. 12, and is comprised of a star-shaped main body 100, with radially extending arms 120, and a hole 110 located generally near the center of the main body 100, comprising of a plurality of tabs 130 around the edge of the hole 110.

Figure 1:
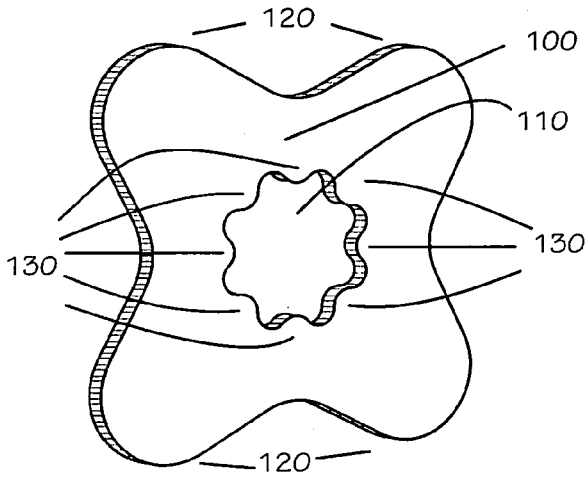
Figure 2:
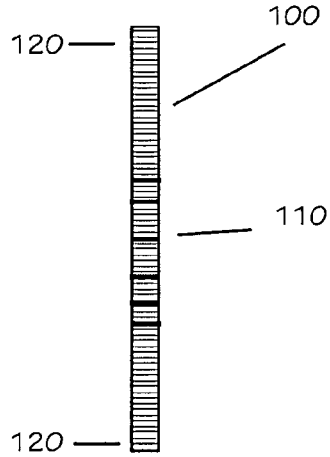
FIG. 2 is a side view of FIG. 1 depicting the generally thin width of the main body 100 when not in use.

FIG. 1 is an isometric front-side view of the main body 100 constructed in accordance with the invention, depicting the front side of the star-shaped main body 100 with radially extended arms 120, and the hole 110. The star-shaped main body 100 is constructed of flexible, elastic, thin, and light-weight material, such as polymeric foam, that is die-cut or laser-cut and lays flat when not in use as depicted in FIG. 2. The radially extended arms 120 provide a stable platform that will rest on a surface 180 after a container 150 is inserted into the hole 110. The tabs around the edge of hole 130 are elastic and stretch to grip and hold the container 150. The number and size of the tabs 130 are predetermined at construction to support the more generally available sized container 150. Due to the material makeup of the present invention, it is easy to clean with soap and water. Simply wash the main body 100 with soap and water and let dry and it is ready for use.

FIG. 2 is a side view of FIG. 1. The thickness of the main body 100 as depicted in FIG. 2 is predetermined based on the average weight and size of the container 150 that will be supported.

Figure 3:
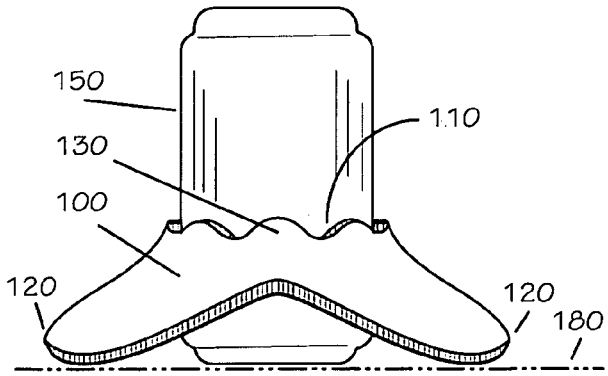
FIG. 3 is a side view of the invention holding a container 150 in an upright position on a solid surface 180.

FIG. 3 is a side view of the invention holding a container 150 within the hole 110. Notice that the insertion of the container 150 into the hole 110, has caused the main body 100 to incurvate and assume a concave shape which adds stability to the main body 100, thereby achieving the invention's objective of providing support for a container 150 in an upright position on a solid surface 180.

Figure 4:
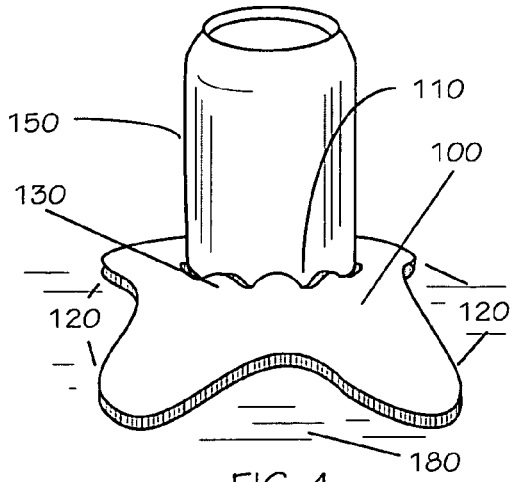
FIG. 4 is an isometric view of FIG. 3 depicting the concave shape that is assumed by the main body 100, when a container is inserted into the hole 110.

FIG. 4 is an isometric view of FIG. 3 depicting the concave shape that is formed by the main body 100, when a container 150 is inserted into the hole 110. Notice that the tabs 130 around the edge of the hole 110 are elastic and have stretched to provide support for the container 150.

FIG. 5 is a top view of the main body 100, depicting a hexagonally-shaped container 160 gripped by the tabs 130 around the hole 110. Notice that the tabs 130 along the edge of the hole 110 are elastic and have stretched to provide support for the hexagonally-shaped container 160. The tabs 130 are an ideal shape for gripping non-circular containers 160.

FIG. 6 is a top view of the main body 100, depicting an oval-shaped container 170 gripped by the tabs 130 around the hole 110. Notice that the tabs 130 along the edge of the hole 110 are elastic and have stretched to provide support for the oval-shaped container 170. The tabs 130 are an ideal shape for gripping non-circular containers 170.

FIG. 7 is a left-side view of the main body 100, depicting an ellipse-shaped container 180 gripped by the tabs 130 around the hole 110. Notice that the tabs on the edge of the hole 130 have stretched to provide support for the ellipse-shaped container 180. The tabs 130 are an ideal shape to form a grip on non-circular containers 180.

FIG. 8 is a left-side view of the invention with an upright water-glass shaped container 190 gripped by the tabs 130 around the hole 110. Notice that the top of the glass 192 is wider than the bottom of the glass 194. The invention can be used with containers that have different diameter tops and bottoms, as long as one diameter is able to fit in the hole 110.

FIG. 9 is a left-side view of the invention with an inverted water-glass shaped container 190 gripped by the tabs 130 around the hole 110. Notice that the water-shaped glass container 190 is in an inverted position. The invention can be used with containers that have different diameter tops and bottoms, as long as one diameter is able to fit in the hole 110.

FIG. 10 is a left-side view of the main body 100 holding a container 150 in an upright position. The wider area formed by the radially extended arms 120 provide a more stable base for the container 150, making it almost tip-proof.

FIG. 11 is a left-side view of the present invention holding a container 150 in an inclined position. The placement of the main body 100 along the edge of the can 150 determines the angle of inclination of the can 150.

FIG. 12 is same view as FIG. 11 of the present invention holding a container 150 in an inclined position, but with the main body 100 installed on the opposite end of the can 154.

FIG. 13 is a left-side view of the present invention holding a container 150 in an upright position suspended on a liquid surface 400. The main body 100 functions as a flotation device for the can 150. The length and width of the main body 100 can be varied to provide sufficient bouyancy for the displacement of the container 150 and its content.

FIG. 14 is the same view of the present invention holding a container 150 in an inclined position suspended on a liquid surface 400. By sliding the main body 100 further down on the containers 50, the top-heaviness of the container causes the main body 100 to assume an inclined position on the liquid surface 400.

FIG. 15 is the same view as FIG. 13, but with the main body 100 installed in an inverted manner. FIG. 15 depicts an alternative method of providing flotation to the container 150 in an upright position, but with the radially extended arms 120 facing downward, into the liquid surface 400.

FIG. 16 is a side view of the main body 100 holding a container 150 on a non-level and non-flat, solid surface 500. Such would be the case if the present invention was placed on a gravel or grassy surface while on a camping trip.

The radially extended arms can be adjusted in an asymmetrical manner to properly grip the container 150 while resting on an inclined surface 500.

FIG. 17 is the same view as FIG. 16, but depicting the main body 100 resting on a semi-level, non-flat solid surface 510. The main body 100 can be adjusted along the container's edge 150 until the container 150 is stable on the semi-level, non-flat solid surface 510.

Conclusion, Ramifications, and Scope of Invention for the Preferred Embodiment

Thus the reader will see that the present invention is inexpensive, lightweight, thin, portable, compact, reusable, easy to clean, and adaptable to different sizes and shapes of containers. It is a highly functional device that provides support for containers on level, non-level, flat and non-flat, solid and liquid surfaces.

Operation of Invention—Holder on a Surface

Referencing FIG. 10, FIG. 11, and FIG. 12, the following steps detail the process of operating this embodiment of the invention:

1. Insert the narrower end of the container, 152 or 154, into the hole 110 located near the center of the main star-shaped body 100. This action will incurvate the main body 100 where it will assume a concave shape.
2. Slide the container 150 inside the hole 110 until the main body 100 is in the desired position.
3. Place the combined structure consisting of the main body 100 and the inserted container 150 onto the desired surface 180 in the desired orientation, such as with the container in an upright, inclined, or inverted position. See FIG. 10, FIG. 11, and FIG. 12.

Description of Alternative Embodiment—Holder for a Baby Bottle

A first alternative embodiment of the present invention is generally depicted in FIG. 18, FIG. 19, and FIG. 20. This embodiment is comprised of an elongated star-shaped main body 600, with radially extended arms 610 and 620 around the edge of the main body 600, and a hole 630 generally located near the center of the main body 600, comprising of a plurality of tabs 640 around the edge of the hole 630.

FIG. 18 is an isometric front-left view of the alternative embodiment of the main body 600 in a flattened state which occurs when it is not in use. This embodiment was conceived to function as a baby-bottle holder for use by a person while feeding a baby. Due to the light weight and compact nature of the main body 600, the present invention can be stored easily within a diaper bag. Due to the material construction of the main body 100, the invention can be easily cleaned with soap and water.

FIG. 19 is a front-left isometric view of FIG. 18 and depicts a baby-bottle 650 inserted into the hole 630. The hole 630 allows for different sized and shaped bottles 650.

FIG. 20 is a side-view of FIG. 19 while in use as a baby-feeding support. The longer arms 620 on one end of the main body 600 are placed on the baby's chest 680. A person using the present embodiment of the invention can rotate the main body 600 to select a suitably sized arm 610 or 620 that provides the correct height for the baby bottle 650 for liquid to flow.

Conclusion, Ramifications, and Scope of Invention for the First Alternative Embodiment Thus the reader will see that the present invention provides a simple, cost-effective, flexible, compact, easy to clean, and highly functional device that address the need to prop a baby bottle on the baby's chest while feeding in order to free up a person's hand for other needs.

Operation of Invention—Holder for a Baby Bottle

Referencing FIG. 18, FIG. 19, and FIG. 20, the operation of the invention comprises of sliding the baby bottle 650 through the hole 630 in the main body 600. The following steps detail the process of operating this embodiment of the invention:

1. Insert the baby bottle 650 into the hole 630 generally located near the center of the main star-shaped body 600. This action will incurvate the main body 600 into a concave shape.
2. Slide the baby bottle 650 inside the hole 630 until the bottle is midway into the hole 630.
3. Place the combined main body 600 with the inserted baby bottle 650 onto the baby's chest 680, resting the structure on the radially extended arms, 610 or 620, depending on the desired height and place the nipple of the baby bottle 660 into the baby's mouth 670.

Description of Another Alternative Embodiment—Suspension of Holder Via a Means of Suspension Such as a Wire The next alternative embodiment of the present invention is generally depicted in FIG, 21 and FIG. 22. This embodiment is also comprised of a star-shaped main body 700, with radially extended arms 720, and a main hole 710 located generally near the center of the main body 700, comprising of a plurality of tabs 730 around the edge of the hole 710. Additionally, each radially extended arm 720 contains a hole 760 located near the edge of the arm 720. The purpose of the hole 760 is to provide a means of attaching a means of suspension, such as a wire or a string 770, so that the wire or string 770 can be attached to a support 780.

FIG. 21 is a side-view of the main body 700 suspended by wires 770 attached to the holes 760 in the radially extended arms 720 with the container 750 in an upright or inverted position.

FIG. 22 is a side-view of the main body 700 suspended by wires 770 attached to the holes 760 in the radially extended arms 720 with the container 750 in an inclined position.

Conclusion, Ramifications, and Scope of Invention for the Next Alternative Embodiment Thus the reader will see that the present invention provides a simple, cost-effective, flexible, compact, easy to clean, and highly functional device that can be used to suspend a container in an upright, inclined or inverted position.

Operation of Invention—Suspension of Holder Via a Means Such as a Wire

Referencing FIG. 21 and FIG. 22, the following steps detail the process of operating this embodiment of the invention:

1. Insert the narrower end of the container, 752 or 754, into the hole 710 located near the center of the main star-shaped body 700. This action will incurvate the main body 700 into a concave shape.
2. Slide the container 750 inside the hole 710 until the desired weight of the container 750 is distributed onto the main body 700, thereby orienting the container 750 into the desired position.
3. Suspend via a suspension means, such as a wire or a string, the combined structure consisting of the main body 700 and the held container 750, using a suspension means, such as a wire or a string 770 that is attached to a support 780.

Embodiments Summary

Although the descriptions in the above embodiments contain much specificity, these should not be construed as limiting the scope of the invention, but as merely providing illustrations of some of the presently preferred embodiments of this invention. For example, the main body can be shaped differently, with more or less radially extended arms. The main body could be covered with decorative indicia and be produced using materials in many colors.

Thus the scope of the invention should be determined by the appended claims and their legal equivalents, rather than by the examples given.

REFERENCE NUMERALS

100 main body of the invention
110 hole in main body that is used to hold the container
120 plurality of radially extended arms
130 plurality of tabs around the edge of the hole
150 container
152 top of container
154 bottom of container
160 hexagonally-shaped container
170 oval-shaped container
184 ellipse-shaped container
190 drinking glass-shaped container
192 wide end of drinking glass-shaped container
194 narrow end of drinking glass-shaped container
400 liquid surface, such as water
500 inclined and irregular surface, such as gravel or a grassy field
510 same as 500, but level
600 alternative embodiment of main body with asymmetrical arms
610 shorter arms on alternative embodiment
620 longer arms on alternative embodiment
630 hole in main body
640 plurality of tabs around the edge of the hole
650 baby bottle
660 baby bottle nipple
670 baby's lips
680 baby's chest
700 main body in a suspended embodiment
710 hole for inserting container
720 plurality of radially extended arms
730 plurality of tabs around the edge of the hole
750 container
752 top of container
754 bottom of container
760 hole in arm used for attaching means of suspension
770 a means of support, such as a wire or a string
780 an upper support from which to suspend the invention

The invention claimed is:

1. A device for holding a container in an upright, inclined, or inverted position comprising:

(a) providing a substantially flat first member of flexible and elastic material of predetermined thickness and (b) said first member having a length and width of sufficient size to support said container and (c) said first member having a predetermined shape comprising of a generally star-shaped main body and (d) said star-shaped body comprising of a plurality of radially extended arms along the outer edge of the main body and (e) said star-shaped body containing a hole there through for inserting said container and (f) said hole comprising of a plurality of tabs along the edge of the hole and (g) said hole having a diameter such that said container fits tightly when inserted within said hole thereby inducing said first member to incurvate into a generally concave shape and (h) said concave shaped first member can be placed upon a surface where the radially extended arms of said concave shaped first member are in contact with said surface and (i) said concave shaped first member can be oriented so that said held container will be in an upright, inclined or inverted position on the surface and whereby said first member will hold said container within said hole and said first member will be incurvated into a concave shape upon the insertion of said container and said first member can be oriented whereby said container held within said hole can be positioned into an upright, inclined or inverted position with respect to said surface and thereby supporting said container on said surface.

2. The main body of claim 1 wherein said surface is a solid surface.

3. The main body of claim 1 wherein said surface is a liquid surface.

4. The main body of claim 3 wherein said liquid surface comprises of water.

5. The main body of claim 2 wherein said solid surface is a level solid surface.

6. The main body of claim 2 wherein said solid surface is a non-level solid surface.

7. A flexible and removable structure for suspending a container in an upright, inclined, or inverted position comprising:

(a) providing a substantially flat first member of flexible and elastic material of predetermined thickness and (b) said first member having a predetermined shape comprising of a plurality of radially extended arms along the outer edge of the first member and (c) said first member having a length and width of sufficient size to support said container and (d) said first member containing a hole there through for inserting said container and (e) said hole comprising of a plurality of tabs along the edge of the hole and (f) said hole having a diameter such that said container fits tightly when inserted within said hole thereby inducing said first member to incurvate into a generally concave shape and (g) said radially extended arms of said concave shaped first member have a hole near the edge that is used to provide a means for attaching a wire or string to suspend the combined structure from a surface and whereby said first member will hold said container within said hole and said first member will be incurvated into a concave shape upon the insertion of said container and said first member are suspended via a wire from said surface thereby supporting said container in an upright, inclined or inverted position from said surface.

* * * * *